US008191301B2

(12) United States Patent
Hatfield

(10) Patent No.: US 8,191,301 B2
(45) Date of Patent: Jun. 5, 2012

(54) FIREARM ATTACHMENT

(76) Inventor: Sam Hatfield, Manassas, VA (US)

( * ) Notice: Subject to any disclaimer, the term of this patent is extended or adjusted under 35 U.S.C. 154(b) by 0 days.

(21) Appl. No.: 12/977,202

(22) Filed: Dec. 23, 2010

(65) Prior Publication Data

US 2011/0154710 A1 Jun. 30, 2011

Related U.S. Application Data

(60) Provisional application No. 61/290,065, filed on Dec. 24, 2009.

(51) Int. Cl.
*F41C 27/00* (2006.01)

(52) U.S. Cl. ..... 42/90

(58) Field of Classification Search ..... 89/1.42, 89/1.4; 42/90, 85, 106, 108, 14, 16; 81/3.05, 81/3.8, 3.08, 3.15, 3.29, 3.4, 3.48
See application file for complete search history.

(56) References Cited

U.S. PATENT DOCUMENTS

| | | | | | |
|---|---|---|---|---|---|
| 1,426,396 | A | * | 8/1922 | Lapointe | 215/226 |
| 1,518,222 | A | * | 12/1924 | Sather | 81/3.29 |
| 2,805,507 | A | | 9/1957 | Buquor | |
| 4,813,333 | A | | 3/1989 | Garris et al. | |
| 5,036,747 | A | | 8/1991 | McClain, III | |
| 5,367,940 | A | | 11/1994 | Taylor | |
| 5,680,723 | A | * | 10/1997 | Ruiz | 42/70.11 |
| 5,930,935 | A | | 8/1999 | Griffin | |
| 6,209,250 | B1 | | 4/2001 | Mills | |
| 6,426,072 | B1 | * | 7/2002 | Wang et al. | 424/184.1 |
| 6,561,073 | B1 | * | 5/2003 | Høgmoe | 89/1.42 |
| 6,595,099 | B1 | | 7/2003 | Olson et al. | |
| 6,807,763 | B1 | | 10/2004 | Leung | |
| 7,146,762 | B1 | | 12/2006 | Leung | |
| 7,194,836 | B1 | | 3/2007 | Urban | |
| 7,707,921 | B1 | * | 5/2010 | Hoel | 89/1.4 |
| 2011/0088539 | A1 | * | 4/2011 | Oz | 89/1.4 |

OTHER PUBLICATIONS

Tromix Rifle Shark Brake (Product Description, accessed from website), Mississippi Auto Arms, Inc., Apr. 7, 2008.

CQB "Close Encounter" (Product Description, accessed from website), AutoBurst Technologies, USP CQB Close Encounter Flash Hider.

* cited by examiner

*Primary Examiner* — Bret Hayes
*Assistant Examiner* — Reginald Tillman, Jr.
(74) *Attorney, Agent, or Firm* — Richard C. Litman

(57) ABSTRACT

An attachment for the slide assembly of a firearm. The attachment includes a pair of laterally opposed arms, each arm having a proximal end and a distal end, the arms being joined by a central portion oriented perpendicular to the arms, the arms and the central portion defining a void therebetween for receiving a portion of the slide assembly, a bridging portion having a radius, disposed in the void and coupled to the central portion, and a flange portion coupled to the bridging portion and having a radius greater than the radius of the bridging portion.

3 Claims, 2 Drawing Sheets

FIREARM ATTACHMENT

CROSS-REFERENCE TO RELATED APPLICATIONS

This application claims priority to U.S. Provisional Application 61/290,065, filed Dec. 24, 2009 and entitled FIREARM ATTACHMENTS, the entire contents of which are hereby incorporated by reference.

BACKGROUND

Semiautomatic firearms are adapted to harness the recoil energy from discharging the firearm so as to automatically eject the shell casing of a fired round and to load a subsequent round into the firing chamber. However, if the firing chamber is empty, for example after reloading the firearm, the slide mechanism of the firearm needs to be manually pulled back and released in order to chamber the first round. This is commonly referred to as "racking the slide" of the firearm.

Racking the slide on a semiautomatic firearm requires sufficient strength to counteract the compression of the recoil spring, and, if present, the firing pin spring. To rack the slide, the user is required to grip the firearm with one hand while using the second hand to grasp the firearm slide and pull the slide towards the rear of the firearm. Thus, racking the slide is an operation that requires the use of both hands as well as a significant amount of strength on part of the user. Indeed, one of the most frequent complaints made about firearms is regarding the difficulty of racking the slide. Thus, a problem exists for users who are weaker, such as the elderly, as well as users who are injured, who do not have sufficient dexterity in both hands to execute the necessary motions, or who are otherwise limited to the use of only one hand.

Accordingly, a device that allows for reduced effort to rack a firearm slide is desired. Additionally, a device that allows the user to rack the slide using either hand is desired. A device that allows a user that is limited to the use of only one hand to rack the slide is also desired.

SUMMARY

According to at least one exemplary embodiment, an attachment for a slide assembly of a firearm is disclosed. The attachment can includes a pair of laterally opposed arms, each arm having a proximal end and a distal end, the arms being joined by a central portion oriented perpendicular to the arms, the arms and the central portion defining a void therebetween for receiving a portion of the slide assembly, a bridging portion having a radius, disposed in the void and coupled to the central portion, and a flange portion coupled to the bridging portion and having a radius greater than the radius of the bridging portion.

According to another exemplary embodiment, a method for racking the slide assembly of a firearm is disclosed. The method can include coupling the attachment to a portion of the slide assembly, applying a force to the engagement face of the attachment so as to move the slide assembly rearward with respect to the firearm, and ceasing the application of the force.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1:
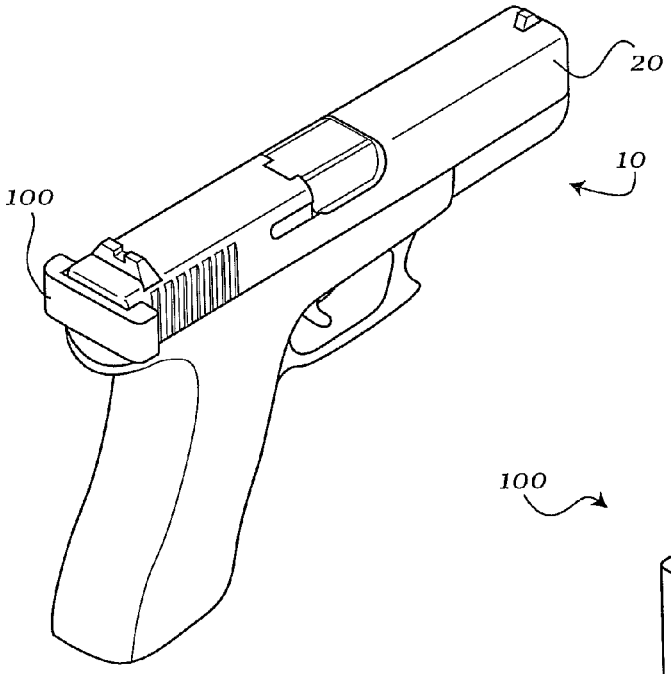
FIG. 1 shows an exemplary embodiment of a firearm attachment coupled to a firearm.
Figure 2A:
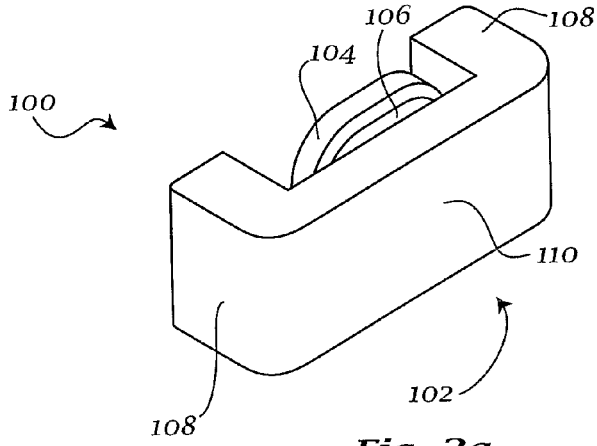
FIG. 2*a* is a first isometric view of an exemplary embodiment of a firearm attachment.
Figure 2B:
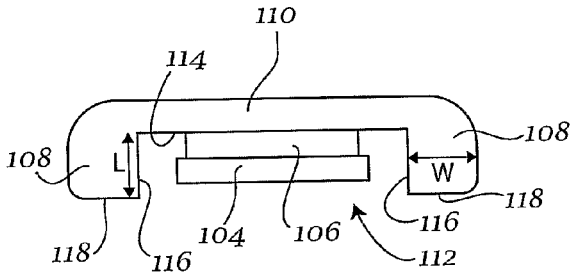
FIG. 2*b* is a plan view of an exemplary embodiment of a firearm attachment.
Figure 2C:
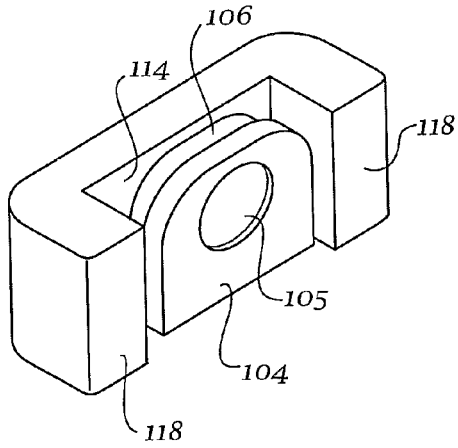
FIG. 2*c* is a second isometric view of an exemplary embodiment of a firearm attachment.
Figure 2D:
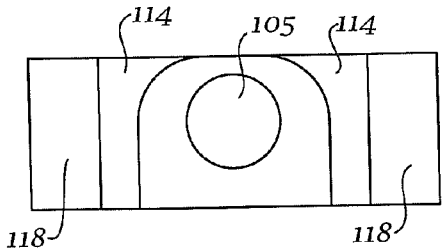
FIG. 2*d* is an elevation view of an exemplary embodiment of a firearm attachment.

According to at least one exemplary embodiment, and referring to FIGS. 1-2*d*, an attachment for the slide assembly of a firearm 10 is disclosed. Attachment 100 may include a body 102 and a flange portion 104 connected to body 102 via bridging portion 106. The attachment may be formed as an integral unit, and may be constructed of any solid, rigid material, for example metal, plastic, or the like. For example, attachment 100 may be constructed from hard-anodized, billet aluminum. Attachment 100 may be adapted to couple to the slide of a firearm, for example as a direct replacement for the cover plate of a firearm such as a Glock pistol.

Body 102 may be substantially U-shaped, and may include laterally opposed arms 108. Arms 108 can be parallel to each other and can be joined at a proximal end thereof by a central portion 110 oriented perpendicular to arms 108. Arms 108 may terminate at a distal end disposed at a length L away from the proximate end of arms 108. Arms 108 and central portion 110 can be oriented so as to define a void 112 into which the slide of a firearm may be received and in which flange portion 104 and bridging portion 106 can be disposed. Arms 108 may also have a width W such that arms 108 may overhang the sides of the slide of the firearm. Both length L and width W may be between approximately 0.25 inches and approximately 0.75 inches.

Central portion 110 can include an interior face 114, an exterior face positioned opposite and parallel to interior face 114, and top and bottom faces positioned opposite and parallel to each other and forming a right angle with each of the exterior and interior faces of central portion 110. Each of arms 108 can likewise include an interior face 116, an exterior face positioned opposite and parallel to interior face 116, and top and bottom faces positioned opposite and parallel to each other and forming a right angle with each of the exterior and interior faces of arms 108. The top face of central portion 110 may be disposed coplanar to the top faces of arms such that body 102 has a smooth top surface. Similarly, the bottom face of central portion 110 may be disposed coplanar to the bottom faces of arms 108 such that body 102 has a smooth bottom surface. Alternatively, the above-described top and bottom faces of the various portions of body 102 can be disposed in any desired arrangement so as to provide a desired aesthetic or functional effect. In other embodiments, at least one notch may be defined in the bottom face of central portion 110 so as to receive any internal mechanisms or structures disposed within the slide assembly that may overlap attachment 100.

The vertices between the exterior face of central portion 110 and the exterior faces of arms 108 may be rounded. The rounding of the exterior vertices may present a desired aesthetic appearance to body 102, and may reduce the likelihood of injuries or damage resulting from an impact of attachment 100 on a body part or on an object. Alternatively, the vertices may be chamfered so as to achieve the described effect.

Each of arms 108 can further include an engagement face 118. The width of engagement face 118 may be substantially similar to the width W of an arm 108. Engagement face 118 can be disposed at the distal end of an arm 108, and can be positioned perpendicular to the interior and exterior faces of arm 108 and parallel to interior face 114 of center portion 110, as well as perpendicular to the top and bottom faces of arm 108. The vertices between the exterior faces of arms 108 and engagement faces 118 may be rounded, with a radius smaller than that of the vertices between the exterior face of central portion 110 and the exterior faces of arms 108. The rounding of the exterior vertices may present a desired aesthetic appearance to body 102, and may reduce the likelihood of injuries or damage resulting from an impact of attachment 100 on a body part or on an object. Alternatively, the vertices may be chamfered so as to achieve the described effect.

Attachment 100 may be adapted to couple to a slide 20 having two side walls 22, a top wall 24 and a partial rear wall 26, wherein the rear wall 26 has a cutout 28 for a rear cover defined therein. An example of such a slide is the one used on the Glock pistol and depicted in FIGS. 1 and 3*a*. However, attachment 100 may be adapted to couple to similarly-configured slides of other firearms without departing from the spirit of the embodiments disclosed herein. When attachment 100 is mounted on the slide of a firearm, engagement faces 118 can be oriented substantially perpendicular to the side walls of the slide of the firearm, and can face towards the muzzle end of the firearm.

As previously discussed, arms 108 and central portion 110 can be oriented so as to define a void 112 into which the slide 20 of a firearm 10 may be received and in which flange portion 104 and bridging portion 106 can be disposed. The walls of the void 112 can be defined by the interior face 114 of central portion 110 and the interior faces 116 of arms 108.

Flange portion 104 may be disposed substantially at the center of interior face 114 of central portion 110 and may have an archlike shape, with the bottom edge of flange portion 104 being coplanar with the bottom face of central portion 110, and the top edge of flange portion 104 having an arcuate shape with an apex coplanar with the top face of central portion 110. The gap between the side edges of flange portion 104 and the thereto-opposed interior faces 116 of arms 108 may be such that a side wall 22 of slide 20 can be disposed therebetween. Flange portion 104 can further include a recess 105 disposed substantially at the center of flange portion 104.

Bridging portion 106 may have a width that is less than the width of flange portion 104 and a height that is less than the height of flange portion 106. Thus, the gap between the side edges of bridging portion 106 and the thereto-opposed interior faces 116 of arms 108 can be greater than the gap between the side edges of flange portion 104 and the same interior faces. Accordingly, sufficient space is provided for the rear wall 26 of slide 20 to be disposed between the side edges of bridging portion 106 and the thereto-opposed interior faces 116.

Figure 3A:
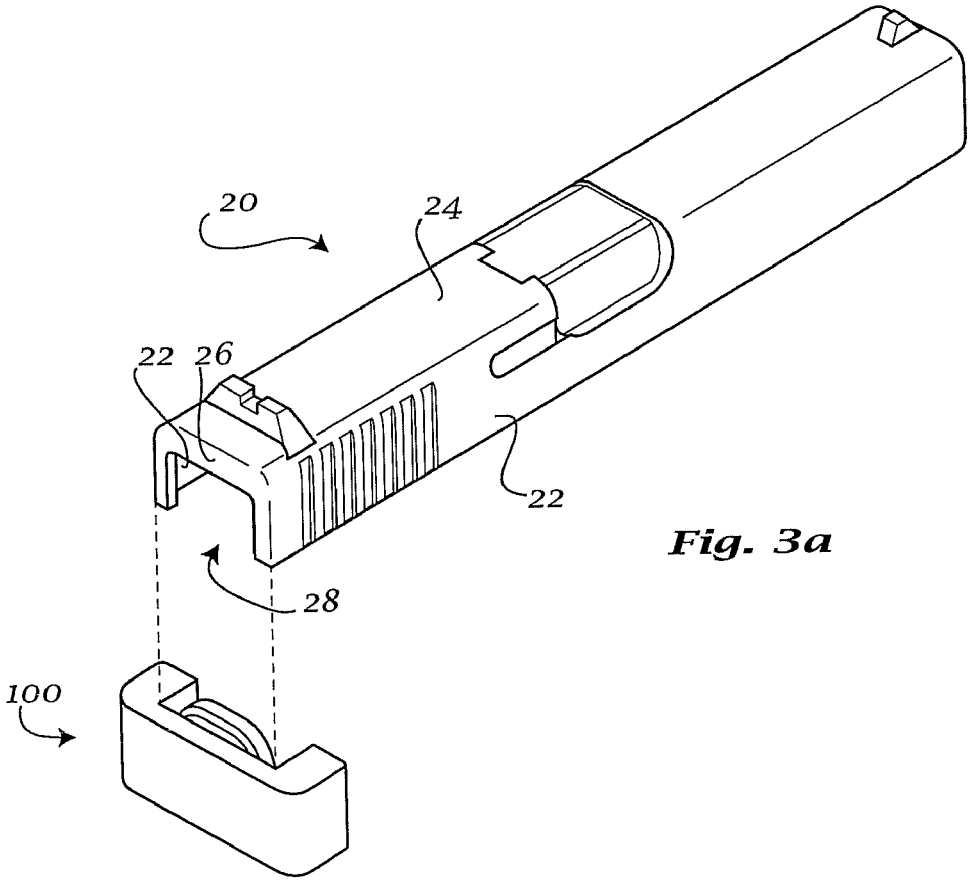
FIG. 3*a* shows an exemplary method of coupling a firearm attachment to a slide assembly of a firearm.
Figure 3B:
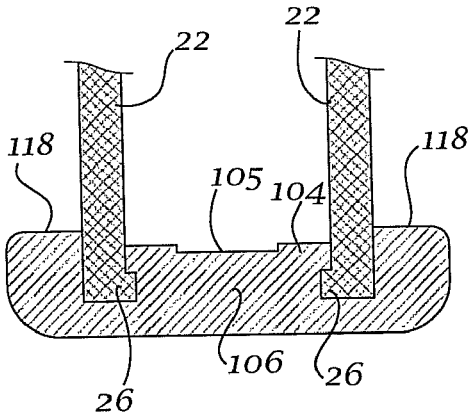
FIG. 3*b* is a cross-sectional view of an exemplary embodiment of a firearm attachment coupled to a slide assembly of a firearm.

Turning now to FIGS. 3*a*-3*b*, attachment 100 may be inserted into the rear end of a slide 20 of a firearm 10. Insertion of attachment 100 may be accomplished via several steps. First, the slide cover, if present, is removed from cutout 28 of slide 20. During the first step, the user can manually retain any internal mechanisms, such as, for example, the firing pin and the extractor spring, so as to prevent the internal mechanisms from exiting the slide. Attachment 100 can then be positioned below the rear end of slide 20, such that the rear wall 26 of slide 20 is aligned with the gap between the side edges of bridging portion 106 and the thereto-opposed interior faces 116 of arms 108. Additionally, the gap between the side edges of flange portion 104 and the thereto-opposed interior faces 116 of arms 108 may be aligned with the side walls 22 of slide 20. Attachment 100 can then be pushed up into the rear end of slide 20, as shown in FIG. 3*a*. After placement into the desired position, attachment 100 may be retained in the position by a friction fit between the attachment and the slide, as well as by the pressure exerted upon the attachment by the internal mechanisms of the firearm.

In operation, attachment 100 may be utilized by a user to rack slide 20 with reduced effort. The attachment may be utilized to rack the slide in a variety of methods. For example, in a two-handed method of racking the slide, the user can grip the firearm with one hand and grasp the attachment with the other hand such that the user's index and middle fingers engage and exert a force on the engagement faces 118 of arms 108. With the hands in such a position, the user can exert a rearward force on engagement faces 118 so as to move the slide rearwardly (with respect to the orientation of the firearm). The user therefore only has to exert a rearward force on the engagement faces of the attachment, as opposed to, in the absence of attachment 100, an inwardly compressive force on the sidewalls of the slide and a simultaneous rearward force on the side walls of the slide. Subsequently, the user can cease the application of force to the engagement faces so as to allow the slide to return to its original position. Thus, the attachment can facilitate reduced effort on part of the user in gripping and racking the slide of a firearm.

As another example, attachment 100 may be utilized in a one-handed method of racking the slide. In such a method, the user can grip the firearm with one hand. The user can then position the firearm against an object such that the object is proximity to or in contact with one of the engagement faces 118 of arms 108. The user may then move the firearm forwardly (with respect to the orientation of the firearm) such that the counteracting force of the object on the engagement face 118 pushes the slide rearwardly, thereby racking the slide. Such objects may include a rigid surface, a firearm holster, a boot heel, a pocket of an article of apparel, or any other object that can remain substantially stationary while a force is applied thereto. Subsequently, moving the firearm away from the object can allow the slide to return to its original position. Thus, the attachment can facilitate one-handed slide racking for users who may be injured or who are otherwise limited to the use of only one hand.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An attachment for a slide assembly of a firearm, comprising:

an integral, one-piece, unitary body adapted to engage the slide assembly of a firearm and be attached thereto, the body including:

a pair of laterally opposed parallel arms, each arm having a proximal end and a distal end, the arms being joined by a central portion oriented perpendicular to the arms thereby defining a substantially U-shaped configuration, wherein the arms and central portion define a void therebetween;

a bridging portion disposed on the interior surface of the central portion and extending upwardly therefrom, wherein the bridging portion is spaced from each of the parallel arms;

a flange portion extending from the upper extent of the bridging portion; and a recess disposed substantially at the center of the outer surface of the flange portion, whereby the slide assembly of the firearm engages both the space between arms and the bridging portion and the recess formed on the flange portion in order to be securely attached thereto.

2. In combination, a firearm and an attachment for a slide assembly of the firearm, comprising:

a firearm including at least a slide assembly, the slide assembly having a front end, rear end, opposed parallel sides and including at least a firing pin, striker spacer sleeve, and firing pin spring;

the attachment including an integral, one-piece, unitary body adapted to engage the slide assembly of a firearm and be attached thereto, the body having:

a pair of laterally opposed parallel arms, each arm having a proximal end and a distal end, the arms being joined by a central portion oriented perpendicular to the arms thereby defining a substantially U-shaped configuration, wherein the arms and central portion define a void therebetween, the arms being sized and configured to extend laterally beyond the parallel sides of the slide assembly;

a bridging portion disposed on the interior surface of the central portion and extending upwardly therefrom, wherein the bridging portion is spaced from each of the parallel arms;

a flange portion extending from the upper extent of the bridging portion; and a recess disposed substantially at the center of the outer surface of the flange portion, whereby the slide assembly of the firearm engages both the space between arms and the bridging portion and the recess formed on the flange portion in order to be securely attached thereto.

3. A method for racking a slide assembly of a firearm according to the combination of claim 2, comprising the steps of:

applying a force to an engagement face of the attachment so as to move the slide assembly rearward with respect to the firearm;

ceasing the application of the force upon racking of the slide assembly; and allowing the slide assembly to return to its original position.

* * * * *